United States Patent [19]

Baculo

[11] 4,106,746

[45] Aug. 15, 1978

[54] ADJUSTABLE FORM CLAMP

[76] Inventor: Umberto A. Baculo, 231 NW. 59th Ct., Miami, Fla. 33126

[21] Appl. No.: 798,633

[22] Filed: May 19, 1977

[51] Int. Cl.[2] ..... E04G 17/12

[52] U.S. Cl. ..... 249/216; 249/20; 249/219 R

[58] Field of Search ..... 249/20–22, 249/213, 216, 219 R, 208, 2–8

[56] References Cited

U.S. PATENT DOCUMENTS

| | | | |
|---|---|---|---|
| 809,106 | 1/1906 | Gehr | 249/21 |
| 1,965,319 | 7/1934 | Romero | 249/213 |
| 2,298,837 | 10/1942 | Oswald | 249/5 |
| 2,513,882 | 7/1950 | Magdiel et al. | 249/20 |
| 3,578,309 | 5/1971 | Freedman | 249/219 R |

*Primary Examiner*—Francis S. Husar

*Assistant Examiner*—John McQuade

*Attorney, Agent, or Firm*—Salvatore G. Militana

[57] ABSTRACT

An adjustable beam clamp for securing a concrete form for the pouring of concrete a beam or lintel that does not require the use of fasteners for securing the form to the wall having a pair of legs engaging the boards that constitute the concrete form. One leg is pivoted to permit the clamp to be expanded when slipping the legs into position over the boards. A threaded rod extends from one leg to the other with a wing nut to draw the two legs tightly together against the boards. Secured to the lower side of the rod is a pair of angle bars which form a downwardly extending slot for receiving the top edges of the boards upon which the clamp rests. A bracket is mounted on the upper end of the one of the legs for receiving a 2 × 4 beam in order to align the clamps along the wall.

1 Claim, 4 Drawing Figures

ADJUSTABLE FORM CLAMP

BACKGROUND OF THE INVENTION

1. Field of the Invention

This invention is directed to clamps for mounting on and securing boards constituting a concrete form in the pouring of concrete beams or lintels on a block wall.

2. Description of the Prior Art

At the present time when a concrete beam or lintel is to be produced on a block wall, the builder will first place and secure boards to the wall extending above the wall to form an open receptacle for receiving the poured concrete which becomes the lintel. Because of the massiveness of the poured concrete, brackets or clamps are fastened to the boards which were fastened to the wall in order to maintain the boards rigidly and against any movement under the tremendous weight of the concrete until the poured concrete has become set. This requires the need for skilled labor having to fasten the boards to the wall properly and then fastening the clamp to the boards, thus resulting in an expensive and time consuming function. The present invention contemplates the avoidance of the necessity to fasten the boards and the clamps in producing a concrete form for the production of a poured concrete lintel or beam.

SUMMARY OF THE INVENTION

Therefore, a principal object of the present invention is to provide a concrete form for producing a poured concrete lintel or beam on a wall which does not require the form to be fastened thereby resulting in a savings in time, labor and money.

Another object of the present invention is to provide a concrete form for pouring lintels on a wall which is simple in construction, readily placed in position on the wall and readily removed therefrom as none of the parts thereof require fasteners for securing the form to the wall.

A further object of the present invention is to provide a concrete form including clamps for pouring beams or lintels on a wall which do not require skilled labor for setting up and removing the forms from the wall.

With these and other objects in view, the invention will be best understood from a consideration of the following detailed description taken in connection with the accompanying drawing forming a part of this disclosure, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
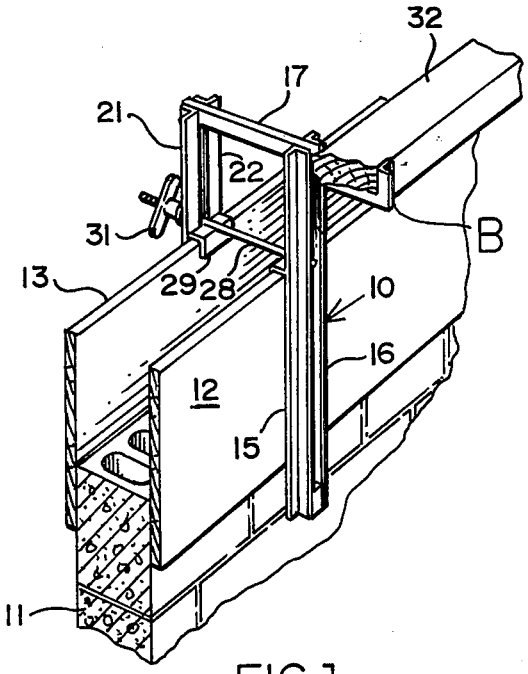
FIG. 1 is a fragmentary perspective view of a wall on which my adjustable beam clamp is mounted for retaining a concrete form for pouring a beam thereon.

Referring to the drawing wherein like numerals are used to designate similar parts throughout the several views, the numeral 10 refers to an adjustable beam clamp constructed in accordance with my invention and shown mounted on a partially constructed block wall 11 to secure boards 12 and 13 thereon as a form for pouring a concrete beam.

My adjustable beam clamp 10 consists of leg members L and M of substantially identical construction, the leg member L consisting of a pair of angle bars 15 and 16 spaced from each other by means of a spacer tubular member 17 having one end extending between and welded to the top end portion of the angle bars 15 and 16. At the bottom end portion of the angle bars 15 and 16 is a short length of a spacer member 18 identical in size to that of the tubular spacer member 17 welded thereto. Intermediate the ends of the angle bars 15 and 16 is an angle bar cross member 19 welded to the inner surfaces of the angle bars 15 and 16, one leg of the angle bar 19 extending downwardly, which in conjunction with the leg portions 15 and 16 form a downwardly extending slot 20 for the reception of the upper edge portion of the form board 12.

The leg member M consists of a pair of angle bars 21 and 22 identical to the angle bars 15 and 16 welded together at the bottom ends thereof in spaced relation by a tubular space member 23. At the top end portions of the angle bars 21 and 22 extends the free end of the spacer member 17 which is provided with a bore 24 for receiving a pivot bolt 25 that extends through openings 26 in the angle bars 21 and 22. A nut 27 threaded on the end of the bolt 25 secures the bolt 25 in position permitting the pivotal movement of the leg member M to swing toward and away from the leg member L as described in greater detail hereinafter.

Extending between the leg members L and M is an elongated bolt 28 with one end positioned between the angle bars 15 and 16 and welded to the cross member 19. The threaded end of the bolt 28 is provided with a cross member 29 identical to the cross member 19 welded thereto. When in use, the bolt 28 extends between the angle bars 21 and 22 and fastened thereto by a washer 30 and a wing nut 31 threaded along the threaded end of the bolt 28. Also when assembled the leg members L and M will be in parallel relation to each other. A bracket B for receiving a 2 × 4 board 32 is mounted on the upper portion of the leg member L consisting of a support member 33 having one end welded to the angle bar 16 and extending horizontally therefrom. At the free end of the angle bar 33 is a vertically disposed angle bar 34 welded at its lower end thereto, forming a slot 35 for receiving the 2 × 4 board 32. The function of the latter structure is to maintain the several beam clamps 10 in a straight line that are mounted in position on the wall 11.

Figure 2:
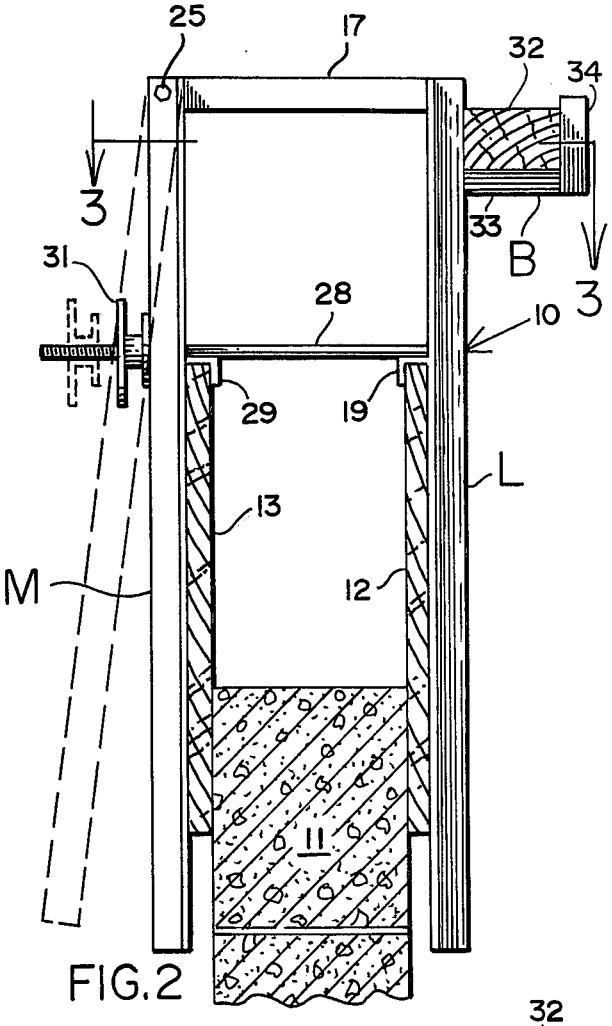
FIG. 2 is a side elevational view thereof.
Figure 4:
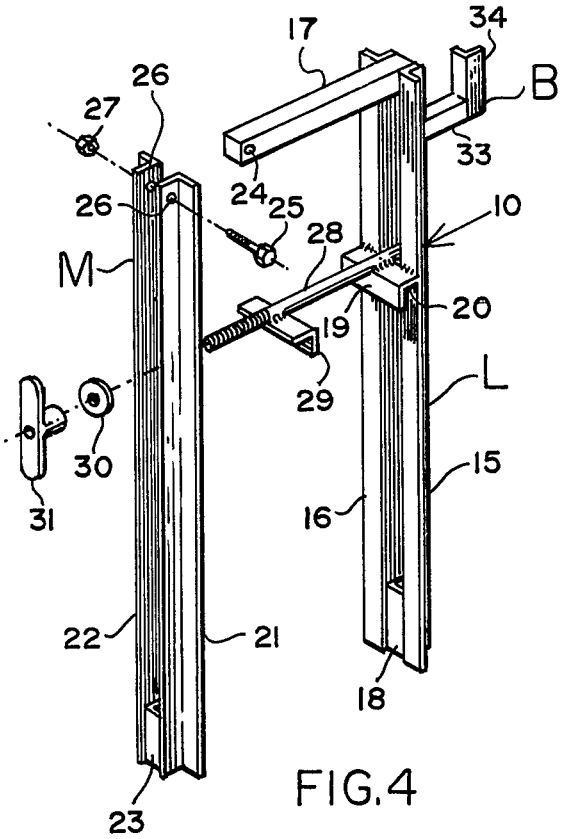
FIG. 4 is an exploded view of the adjustable beam clamp.
Figure 3:
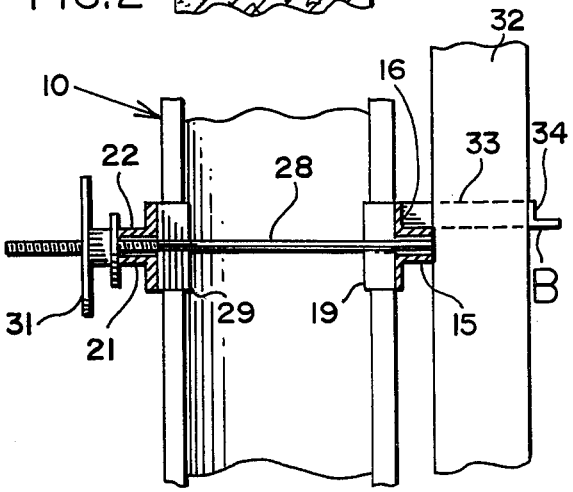
FIG. 3 is a cross sectional view taken along the line 3—3 of FIG. 2.

When the wall 11 is ready for the concrete lintel or cap to be poured thereon, a pair of board 12 and 13 are placed on either side and above the wall 11 as shown in FIG. 1. The boards 12 and 13 are held only momentarily in position until my adjustable beam clamp 10 is secured in position thereon. The wing nuts 31 are threaded outwardly and the leg member M swung outwardly to the dotted line positions as shown by FIG. 2. The beam clamp 10 is then slipped over the top edges of the boards 12 and 13 and slid downwardly until the angle bar 19 received the top edge of the board 12. The leg portion M is then swung inwardly until the angle bar 29 received the top edge of the board 13 and the wing nut is then tightened against the leg member M to the solid line position as shown in FIG. 2. After several beam clamps 10 have been secured in position on the wall 11, the 2 × 4 beam 32 is placed in the brackets B to align the boards 12 and 13 in forming the lintel form to be poured.

After the concrete lintel has been poured and set, the 2 × 4 beams 32 are lifted out of the brackets B, the wing nuts 31 are unthreaded and the leg member M pivoted outwardly about the pivot pin 25 to the dotted line position. At this time the beam clamps 10 are lifted off the boards 12 and 13, and the latter removed from their position on the wall 11 ready to be reused. It is to be noted that no portion of the boards 12 and 13 or the clamps 10 are fastened to the wall 11 or to each other thereby rendering the pouring of a beam easily accomplished by equipment that is reusable as often as desired.

I claim:

1. An adjustable beam clamp comprising a pair of elongated leg members in spaced and substantially parallel relation to each other, a cross member secured at one end to the upper end portion of one of said elongated leg members and extending in the direction of the other of said elongated leg members, pivot means mounting the other end of said cross member to the upper end portion of said other of said elongated leg members, an angle bar secured to an inner surface of said one of said elongated leg members, said angle bar having leg portions extending horizontally and downwardly for receiving the top edge of a board forming one side of a concrete form, a threaded rod secured to said angle bar at one end and its threaded end extending beyond said other of said elongated leg members, nut means threadedly mounted on said threaded rod adapted to engage and cause said other of said elongated leg members to pivot about said pivot means, a second angle bar secured to the lower surface of said threaded rod, said second angle bar having leg portions extending horizontally and downwardly for receiving the top edge of a board forming the other side of said concrete form and bracket means mounted on said upper portion of said one of said elongated leg members and extending in a direction away from said other of said elongated leg members.

* * * * *